US007380911B2

(12) United States Patent
Pinard et al.

(10) Patent No.: US 7,380,911 B2
(45) Date of Patent: Jun. 3, 2008

(54) JET PRINTER WITH ENHANCED PRINT DROP DELIVERY

(75) Inventors: Adam I. Pinard, Carlisle, MA (US); Roland Guilmet, Pepperell, MA (US); Foster M. Fargo, Jr., Lincoln, MA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/842,200

(22) Filed: May 10, 2004

(65) Prior Publication Data

US 2005/0248618 A1 Nov. 10, 2005

(51) Int. Cl.
*B41J 2/04* (2006.01)
*B41J 2/06* (2006.01)

(52) U.S. Cl. ..... 347/54; 347/55

(58) Field of Classification Search ..... 347/54, 347/74, 75, 77, 55

See application file for complete search history.

(56) References Cited

U.S. PATENT DOCUMENTS

| | | | | |
|---|---|---|---|---|
| 4,800,396 | A | 1/1989 | Hertz | 346/1.1 |
| 4,809,016 | A * | 2/1989 | Padalino | 347/41 |
| 5,202,772 | A | 4/1993 | Muir | 358/459 |
| 5,328,438 | A | 7/1994 | Crowley | 493/187 |
| 5,423,617 | A | 6/1995 | Marsh et al. | 400/82 |
| 5,534,904 | A | 7/1996 | Sheinman | 347/75 |
| 5,570,632 | A | 11/1996 | Cumens et al. | 101/35 |
| 5,825,391 | A | 10/1998 | Yang | 347/106 |
| 5,946,454 | A * | 8/1999 | Shu et al. | 358/1.9 |
| 5,949,455 | A * | 9/1999 | Williams | 347/76 |
| 5,960,933 | A | 10/1999 | Albrecht | 198/689.1 |
| 5,969,733 | A | 10/1999 | Sheinman | 347/75 |
| 6,003,980 | A | 12/1999 | Sheinman et al. | 347/78 |
| 6,102,536 | A | 8/2000 | Jennel | 347/100 |
| 6,106,107 | A | 8/2000 | Sheinman | 347/75 |
| 6,135,654 | A | 10/2000 | Jennel | 400/61 |
| 6,295,737 | B2 | 10/2001 | Patton et al. | 33/18.1 |
| 6,626,527 | B1 * | 9/2003 | Pinard | 347/74 |

FOREIGN PATENT DOCUMENTS

| | | |
|---|---|---|
| DE | 3526769 | 1/1987 |
| EP | 0620117 | 10/1994 |
| GB | 2335885 | 10/1999 |
| JP | 60052356 A | 3/1985 |
| JP | 60107975 | 6/1985 |
| JP | 5293955 A | 11/1993 |
| JP | 5318715 | 12/1993 |
| JP | 7052525 A | 2/1995 |
| JP | 2001315316 A | 11/2001 |
| WO | WO 97/27053 | 7/1997 |
| WO | WO 97/42034 | 11/1997 |

* cited by examiner

*Primary Examiner*—An H. Do
(74) *Attorney, Agent, or Firm*—Nelson Adrian Blish

(57) ABSTRACT

Disclosed is a jet printing method, which includes firing printing fluid drops and deflecting them. The drops are then deflected again in a second direction, which can allow them to be deposited in a collimated swath. Also disclosed is dynamically adjusting the deflection to achieve a dynamic swath density and/or a dynamic swath width.

12 Claims, 5 Drawing Sheets

JET PRINTER WITH ENHANCED PRINT DROP DELIVERY

CROSS-REFERENCE TO RELATED APPLICATION

This application is related to an application entitled STITCHED PRINTING SYSTEM, filed May 10, 2004 under Ser. No. 10/842,196 (U.S. Patent Application Publication No. 2005/248631), which is herein incorporated by reference.

FIELD OF THE INVENTION

This invention relates to jet printers with enhanced deflection systems, such as continuous ink-jet printers with enhanced swathing capabilities.

BACKGROUND OF THE INVENTION

Swathing continuous inkjet printers are well known in the art, and are described, for example, in U.S. Pat. No. 6,511,163, and European Patent Application No. EP1197334, which are both herein incorporated by reference. These types of printers generally employ a pair of deflection electrodes that deflect ink drops fired from a nozzle to produce a divergent set of drop paths called a swath. The width of this swath, measured between the two outermost drop paths, typically needs to be calibrated to maintain a predetermined drop spacing and to ensure that drops deposited in adjacent swaths do not overlap. Swathing printers usually perform this type of calibration with a probe or camera that is located away from the print substrate, and this configuration prevents printing and calibration from taking place at the same time.

SUMMARY OF THE INVENTION

In one general aspect, the invention features a jet printer that includes a first deflection element located proximate a first portion of an output trajectory of a nozzle, and positioned to deflect printing fluid drops exiting the nozzle in a first direction. A second deflection element is located proximate a second portion of the output trajectory that is further downstream and positioned to again deflect the printing fluid drops in a second direction. The second direction is different from the first direction, but the first and second directions have at least their primary components in a same plane.

In preferred embodiments, the first deflection element can be one of a first pair of deflection electrodes, with the second deflection element being one of a second pair of deflection electrodes. The printer can further include half-tone imaging logic operative to drive the printer to print half-tone images on the print substrate. The printer can be operative to print on a printing plate. The printer can be a proofer that further includes logic operative to simulate another printing process. The printer can further include swathing logic operative to cause the deflection elements to deposit the printing fluid drops at different positions with respect to the first jet printing nozzle. The swathing logic can specify a jumbled firing order. The second deflection element can be oriented to cause the printing fluid drops in different positions in the swathed pattern to travel in at least generally parallel trajectories. A third deflection element can be located proximate a third portion of the output trajectory of the first jet printing nozzle that is further downstream from the nozzle than the second portion, with the third deflection element being positioned to yet again deflect the printing fluid drops in a third direction different from the second direction. The third deflection element can be positioned to cause the second and third directions have at least their primary components in a same plane. The printer can further include an actuating mechanism operative to provide relative motion between a print substrate and the first jet printing nozzle. The actuating mechanism can include a web, a drum, and/or a platen. The actuating mechanism can include a member that supports the first jet printing nozzle. The actuating mechanism can include an actuator for conveying a substrate that includes a three-dimensional printing surface. The actuating mechanism can be operative to convey a large number of the substrates in a continuous process. The actuating mechanism can be operative to hold a plastic bottle. The bottle can be at least a partially non-cylindrical plastic bottle. The actuating mechanism can be operative to convey a large number of plastic bottles in a continuous process. The actuating mechanism can include an actuator for conveying the nozzle relative to a fixed substrate support surface. The actuating mechanism can include a loading mechanism and a feed mechanism. The printer can further include a second jet printing nozzle, a third deflection element located proximate a first portion of an output trajectory of the second jet printing nozzle and being positioned to deflect printing fluid drops exiting the second jet printing nozzle in a third direction, and a fourth deflection element located proximate a second portion of the output trajectory of the second jet printing nozzle that is further downstream from the second jet printing nozzle than the first portion of the output trajectory of the second jet printing nozzle, with the second deflection element being positioned to again deflect the printing fluid drops exiting the second jet printing nozzle in a fourth direction different from the third direction. The output trajectory of the first nozzle can be at least generally parallel to the output trajectory of the second nozzle. The printer can further include interleaving logic operative to provide different, interleaved subsets of data for a single image to the first and second nozzles. The printer can further include an actuating mechanism operative to actuate a first substrate in proximity to the first jet printing nozzle and a second substrate in proximity to the second jet printing nozzle. The printer can further include a charging tunnel that is positioned upstream from the first portion and operative to charge the drops to different degrees. The printer can be a continuous inkjet printer. The first and second directions can be substantially coplanar.

In another general aspect, the invention features a jet printing method that includes firing printing fluid drops, deflecting the printing fluid drops fired in the step of firing in a first step of deflecting, and deflecting the printing fluid drops in a second step of deflecting after the first step of deflecting and in a direction different from a direction in which they were deflected by the first step of deflecting, with the first and second steps of deflecting having at least their primary deflection components in a same plane.

In preferred embodiments, the first step of deflecting can deflect the printing fluid drops fired in the step of firing in a swathed pattern. The second step of deflecting can deflect at least some of the printing fluid drops onto at least generally parallel trajectories. The parallel trajectories can be at least generally parallel to an undeflected trajectory that the printing fluid drops would follow in the absence of the first and second steps of deflecting.

In a further general aspect, the invention features a jet printing method that includes means for firing printing fluid drops, means for deflecting the printing fluid drops fired by the means for firing printing fluid drops, and means for again deflecting the printing fluid drops in a direction different from a direction in which they were deflected by the means for deflecting printing fluid drops, with the means for deflecting and the means for again deflecting having at least their primary deflection components in a same plane In another general aspect, the invention features a jet printing method that includes receiving a series of printing fluid drops traveling along an input trajectory, and electrostatically redirecting different ones of the printing fluid drops from the input trajectory onto a plurality of different output trajectories having at least one convergence point outside of the part of the printing fluid drop input trajectory followed by the printing fluid drops before the step of redirecting.

In a further general aspect, the invention features a jet printer that includes a first jet printing nozzle, at least one deflection element located proximate an output trajectory of the first jet printing nozzle and being positioned to deflect printing fluid drops exiting the first jet printing nozzle, and dynamic swath adjustment logic responsive to a dynamic swath adjustment signal and operative to dynamically adjust a signal provided to the deflection element during deposition of ink by the first ink jet printing nozzle.

In preferred embodiments, the dynamic swath adjustment signal can be a swath density adjustment signal, with the dynamic swath adjustment logic being operative to adjust a swath density defined by the deflection element within a swath, based on the swath density signal. The variable swath density logic can be operative to adjust a drop separation increment. The dynamic swath adjustment signal can be derived from a three-dimensional print substrate specification. The dynamic swath adjustment signal can be a target swath-width signal, with the dynamic swath adjustment logic being operative to scale the signal provided to the deflection element during deposition of ink by the first ink jet printing nozzle. The dynamic swath-width adjustment logic can further include offset correction logic operative to introduce an offset in the signal provided to the deflection element during deposition of ink by the first ink jet printing nozzle. The dynamic swath-width adjustment logic can be responsive to a substrate advance signal and to substrate shape information. The printer can further include half-tone imaging logic operative to drive the printer to print half-tone images on the print substrate. The print substrate can be a printing plate. The printer can further include an actuating mechanism that includes an actuator for conveying a substrate that includes a three-dimensional printing surface. The actuating mechanism can be operative to hold a container. The actuating mechanism can be operative to hold a three-dimensional plastic object, which can be a plastic bottle. The actuating mechanism can also be operative to hold at least a partially non-cylindrical plastic bottle. The actuating mechanism can also be operative to hold a three-dimensional metal object, and it can be operative to hold a three-dimensional semi-rigid object.

In another general aspect, the invention features a jet printing method that includes generating a series of jet printing fluid drops destined to be deposited on a three-dimensional substrate, deflecting the drops after they are generated but before they reach the substrate, and dynamically adjusting the step of deflecting as the series of drops are being generated.

In preferred embodiments, the step of dynamically adjusting can be operative to dynamically adjust the density of ink deposition within a swath. The step of dynamically adjusting can be operative to dynamically adjust the swath width. The step of dynamically adjusting can be based on a stored three-dimensional profile.

In a further general aspect, the invention features a jet printer that includes means for generating a series of jet printing fluid drops destined to be deposited on a three-dimensional substrate, means for deflecting the drops after they are generated but before they reach the substrate, and means for dynamically adjusting the means for deflecting as the series of drops are being generated.

In another general aspect, the invention features a jet printer that includes a first jet printing nozzle, at least one deflection element located proximate an output trajectory of the first jet printing nozzle and being positioned to deflect printing fluid drops exiting the first jet printing nozzle, and transit time correction logic responsive to a three-dimensional print substrate specification and operative to adjust a transit time correction value.

In preferred embodiments, the transit time correction logic can include depth-dependent transit time correction logic responsive to a three-dimensional print substrate specification and operative to adjust the transit time correction value depending on a distance between the nozzle and a corresponding deposition position. The transit time correction logic can include intra-swath transit time correction logic responsive to a three-dimensional print substrate specification and operative to adjust the transit time correction value within a swath.

In a further general aspect, the invention features a jet printing method that includes generating a series of jet printing fluid drops destined to be deposited on a three-dimensional substrate, deflecting the drops after they are generated but before they reach the substrate, and dynamically adjusting a transit time correction value for the drops depending on a distance between the nozzle and a corresponding deposition position for the drops. In preferred embodiments, the step of dynamically adjusting can take place within a swath.

In another general aspect, the invention features a jet printing method that includes generating a series of jet printing fluid drops destined to be deposited on a three-dimensional substrate, displacing the substrate in a path of the jet printing fluid drops generated in the step of generating, and dynamically adjusting the drop deposition spacing on the substrate drops as the substrate is displaced.

In preferred embodiments, the step of dynamically adjusting can dynamically adjust a deposition time for the drops generated in the step of generating. The step of dynamically adjusting can dynamically adjust a substrate velocity for the step of displacing. The step of dynamically adjusting a substrate velocity can operate by adjusting signals provided to an actuator used in the step of displacing to displace the substrate. The step of displacing the substrate can include rotating the substrate.

Systems according to some embodiments of the invention are advantageous in that they can be designed to deposit drops through collimated, parallel drop paths. This property allows deposition to take place with less regard to the accuracy of spacing between nozzle and substrate. Systems according to the invention can therefore be used to print on sheets of widely varying thicknesses without recalibrating. They may also be less sensitive to local aberrations, such as can arise when a substrate is not tightly held to its support. And they may even be used to print on three-dimensional objects.

Systems according to the invention may also exhibit reduced sensitivity to errors and drifts. Small positioning errors in the drop generation process, for example, may result in smaller print errors than might occur in a divergent swath, because these errors are not magnified by the angle of divergence. And artifacts caused by drum or lead-screw positional errors or eccentricities that affect the distance between nozzle and sheet may be less visible because these types of errors have less of an impact on the swath width at the paper surface. This reduced impact may result in improved print quality, or in a reduced calibration time requirement and a corresponding increase in printer uptime. It may also allow for the use of less expensive mechanical and/or electrical components to achieve a given print quality level. For example, a printer that can tolerate some looseness of its substrate around a drum may not need to be built with a complex vacuum system.

And systems equipped with dynamic swathing adjustment features can allow for printing on a variety of different three-dimensional substrates. Dynamically varying the separation of drops within a swath can allow a printer to evenly deposit ink on a surface that slopes away from a printing nozzle. Dynamically varying the width of a swath can allow the printer can deposit ink onto surfaces at different distances from the nozzle while maintaining a uniform dot pitch. And dynamically varying drop timing can allow the printer to print despite variations in drop travel distance, even within a swath.

DETAILED DESCRIPTION OF AN ILLUSTRATIVE EMBODIMENT

Figure 1:
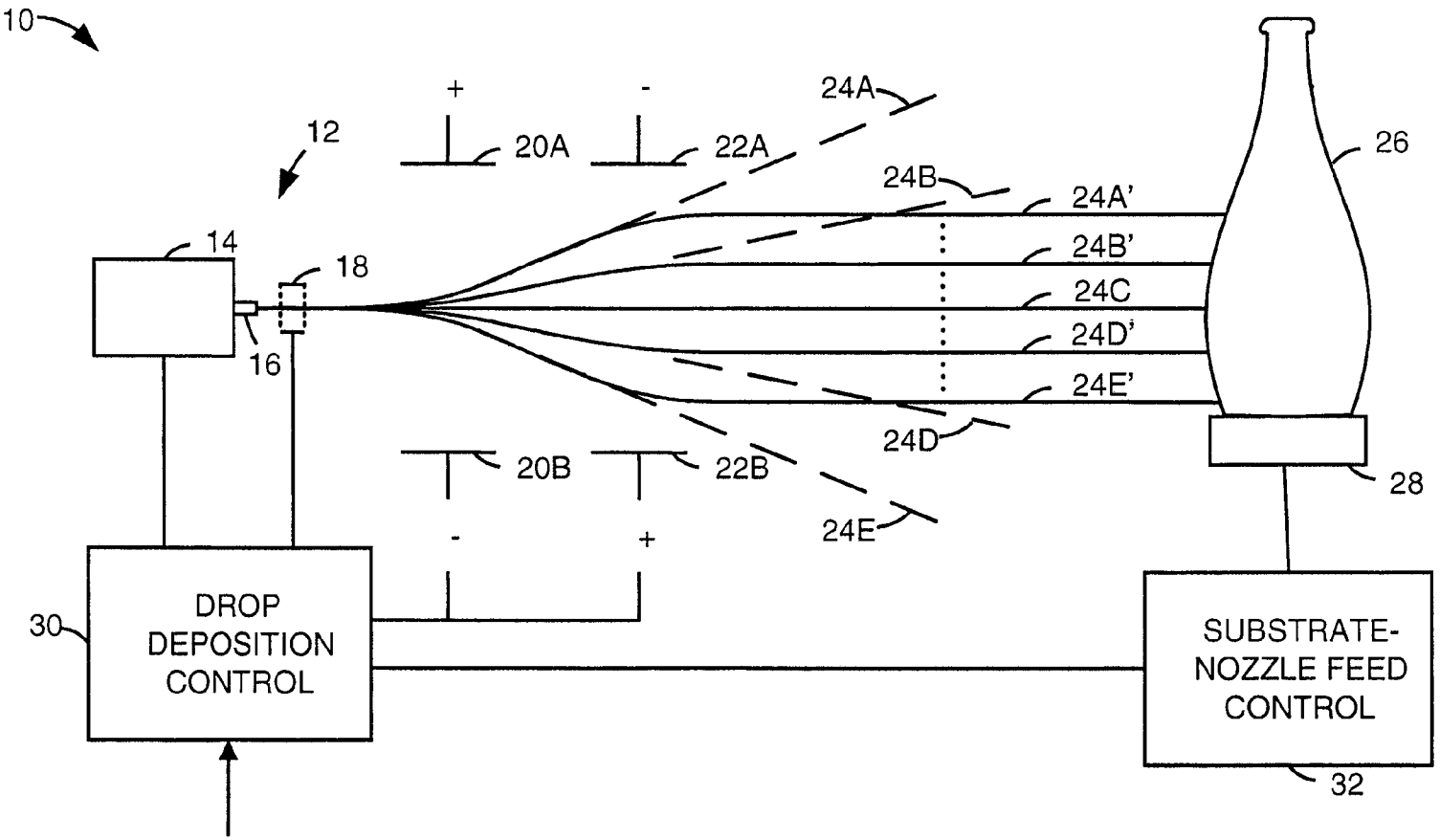
FIG. 1 is a diagram illustrating a printing system according to the invention.

Referring to FIG. 1, a printing system 10 includes a drop source 12, which can be a continuous ink drop source. This type of source preferably includes a pump 14, a nozzle 16, and a drop-charging electrode, such as a charge tunnel 18. Two sets of deflection elements 20, 22 are positioned in succession along an output trajectory of the drop source. The first deflection element preferably includes a first pair of deflection electrodes 20A, 20B located on either side of the output trajectory of the ink drop source 12 at a first position along the trajectory. The second deflection element preferably includes a second pair of deflection electrodes 22A, 22B located on either side of the output trajectory of the ink drop source at a second position that is downstream from the first pair of electrodes.

A drop deposition control module 30 has control outputs that can provide deflection voltages to the deflection elements 20, 22, data signals to the charging tunnel 18, and control signals to the pump 14 and/or other elements of the drop source 12. Note that while the functions of the drop deposition control module are shown as provided in a single grouping, its functions in this and other embodiments may also be combined or further subdivided. And while electrical control and drop deflection are presently considered to be preferable, control and/or deflection can be provided using other principles, such as mechanical, magnetic, and/or pneumatic principles.

A substrate-nozzle feed control module 32 can interface with the drop deposition control module 30, and can control relative motion between the drop source and a print substrate 26. In the embodiment shown in FIG. 1, the substrate can be a three-dimensional article, such as a bottle, which is supported by a revolving actuator that has an input operatively connected to a control output of the substrate-nozzle feed control module. Other feed arrangements could also be used, however, to load the substrate and/or provide relative motion between the nozzle and the substrate during printing. These can include drums, platens, or other mechanisms for advancing the substrate with respect to the nozzle, and/or lead-screws, toothed belts, and/or stepper motors that advance the nozzle with respect to the substrate. In some embodiments, the actuation may be provided by auxiliary equipment, such as a conveyor belt. And some embodiments may not need any active actuation at all.

In operation, the drop source 12 generates a continuous stream of charged drops that follow a predetermined output trajectory. The first pair of deflection electrodes 20A, 20B exerts a force on the drops passing between them, and this force has a magnitude that depends on the charge on the drops and the voltage applied across the deflection electrodes. Adjusting the charge applied to the drops and/or the voltage applied to the electrodes therefore allows the drops to be deflected into one of a series of divergent swathed paths 24A, 24B, 24D, 24E.

The second pair of deflection electrodes 22A, 22B exerts a second force on the drops passing between them, and this force has a magnitude that depends on the charge on the drops and the voltage applied across the second pair of deflection electrodes. The direction of this force is different from that applied by the first set of electrodes, and can be set up to be just sufficient to cause the drops to move from their divergent paths 24A, 24B, 24D, 24E onto a collimated set of coplanar paths 24A,' 24B,' 24D,' 24E' that are parallel to each other and to the path 24C of an undeflected drop. Other positional arrangements are also possible, however, such as arrangements that produce parallel, divergent, and/or convergent drop paths, and these arrangements may or may not include drop paths parallel to an undeflected path.

In the embodiment shown in FIG. 1, the first set of electrodes 20A, 20B and the second set of electrodes 22A, 22B are held at equal and opposite fixed voltages (e.g., zero volts and 2,400 volts). A voltage applied to the charge tunnel 18 is then adjusted based on a data signal to deflect the drops along different ones of the collimated set of parallel paths 24A,' 24B,' 24D,' 24E.' Other driving signal arrangements can also be used in this or other positional arrangements, however, with variable drop charges and/or deflection forces. These can include unipolar or bipolar deflection voltages with different types of relationships between the signals that drive the first and second pairs of electrodes.

Minimizing throw length, which is the distance from the nozzle to the print substrate, is an important design consideration. This keeps the drops from losing velocity, and thereby reduces positional errors between drops. These kinds of positional errors can be further reduced by accurately modeling the forces acting on the drops during flight, and applying appropriate timing and deflection corrections to individual drops. Suitable methods for this type of approach are disclosed, for example, in U.S. Pat. No. 6,511,163, which is referenced above.

The system can also take the state of the air through which a drop is traveling into consideration. If no drop has been fired for a long time, for example, the relatively still air in a drop's path will slow it more than if a number of drops had just been fired through a same or proximate path by a same or different nozzle. This effect can be corrected for by introducing, for each drop, a delay having a length that depends on the estimated relative air velocity in the air for that drop at that time. The estimated relative air velocity model used to derive the drop delay should preferably take into account earlier drops from the same nozzle as well as earlier drops from other proximate nozzles.

Where the printing system 10 prints on three-dimensional objects with multiple nozzles, the system may also need to compensate for differences in transit times. This is because delays introduced to match the transit times of nozzles at one distance from the nozzles will not necessarily be correct at another distance. The system can make up for these differences by maintaining a series of depth-dependent delay values and selecting the appropriate delay for the each drop, depending on the depth at which the drop is to be deposited.

Systems according to the invention can also benefit from dynamic swath adjustment. This feature allows a printer to adjust its swathing parameters during printing. This kind of adjustment can permit uniform printing on a variety of three-dimensional surfaces.

Figure 2:
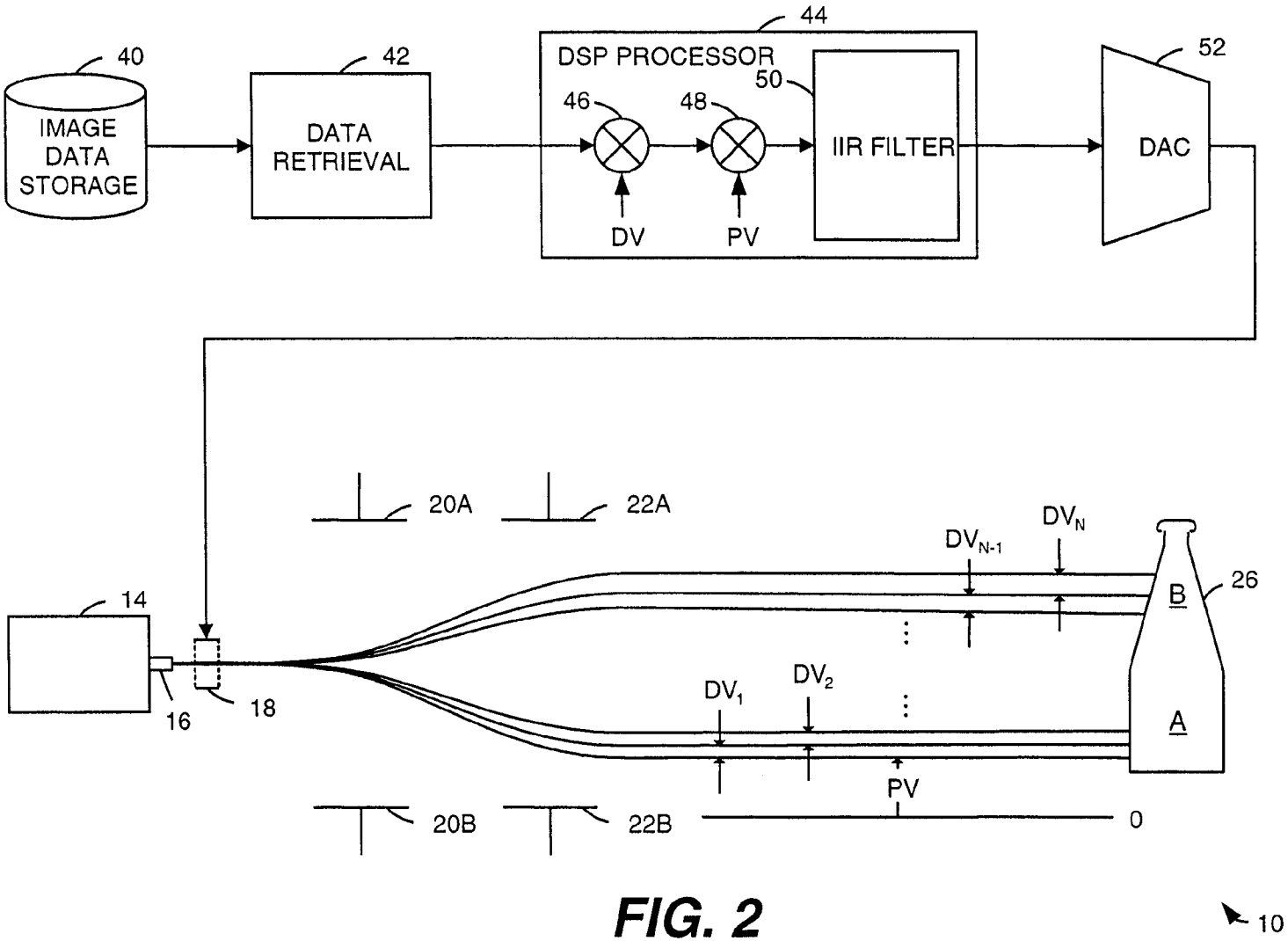
FIG. 2 is a diagram illustrating an embodiment of the printing system of FIG. 1 that provides dynamic swath density adjustment.

Referring to FIG. 2, a printing system equipped with a first type of dynamic swath adjustment can provide for variable image density logic in its deposition control module to compensate for distortions that may arise in printing on three-dimensional objects. This type of system can include a data retrieval module 42 that has an input operatively connected to an output of an image data storage unit 40, and an output operatively connected to a Digital Signal Processing (DSP) processor 44. The DSP processor can provide a first summer 46 that has summing inputs operatively connected to the data retrieval module and to a separation increment signal line (DV), and a second summer 48 that has summing inputs operatively connected to an output of the first summer and an offset signal line (PV). The DSP processor can also provide an Infinite Impulse Response (IIR) filter 50 that has an input operatively connected to an output of the second summer and an output operatively connected to an input of a Digital-to-Analog-Converter (DAC) 52.

In this embodiment, the printing system 10 can adjust a separation increment DV such that the density of ink deposited on a substrate 26 is uniform. In the case of the bottle shown in FIG. 2, for example, the cylindrical section A of its lower portion will require more ink than the narrower parts of its tapered neck B. And the tapered neck will require less and less ink as it becomes narrower. The printing system accommodates these disparate needs by varying a drop separation increment DV across the swath width. The result is that drops deposited with different deflections can be more sparsely spaced in areas that require less ink ($DV_{n-1}$, $DV_n$), and more densely spaced in areas that require more ink ($DV_1$, $DV_2$). The printing system may also vary the base offset PV in certain instances, such as to account for skewed carriage travel.

The printing system 10 begins its operation with the data retrieval module 42 retrieving print data from the image storage unit 40. This retrieval operation can take place in an order that is defined by an interleaving sequence and/or a jumbled firing order, and pixel data therefore may not be retrieved sequentially for adjacent positions. For each retrieved pixel (or drop), the DSP processor 44 adds a separation increment and a base offset that correspond to the position of the pixel to be deposited. These added values are part of a profile that is based on the shape of the substrate, and they can be retrieved from a table, computed from a formula, or otherwise derived on the fly from data that specifies at least some information about the shape of the substrate.

The IIR filter further processes the position data to account for other effects, such as adjacent drop and aerodynamic effects, as described in U.S. Pat. No. 6,511,163 and European Patent Application No. EP197334. The final output of the IIR filter for each drop is converted into a deflection voltage, which causes the drop to follow one of the deposition trajectories within the swath.

Other methods for varying the printing intensity may also be employed. For example, it is possible to pre-emphasize the data set to be printed such that the image intensity values it contains vary in relation to the shape of the object, in one or more dimensions. It may also be possible in some applications to skip some of the data to be printed in areas where a lower ink density is required.

Figure 3A:
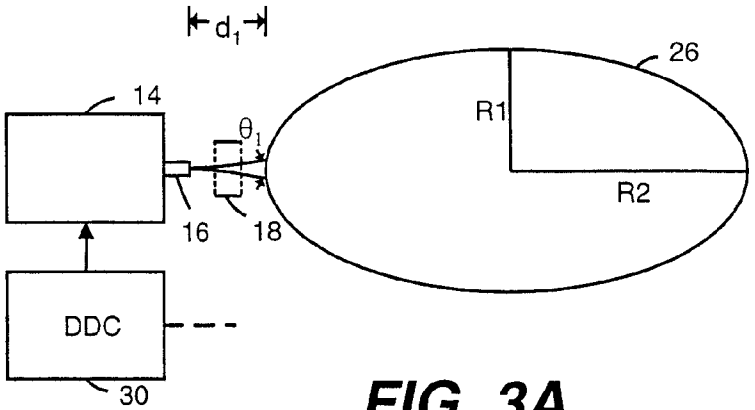
FIG. 3 is a diagram illustrating of an embodiment of the printing system of FIG. 1 that provides dynamic swath width adjustment.
Figure 3B:
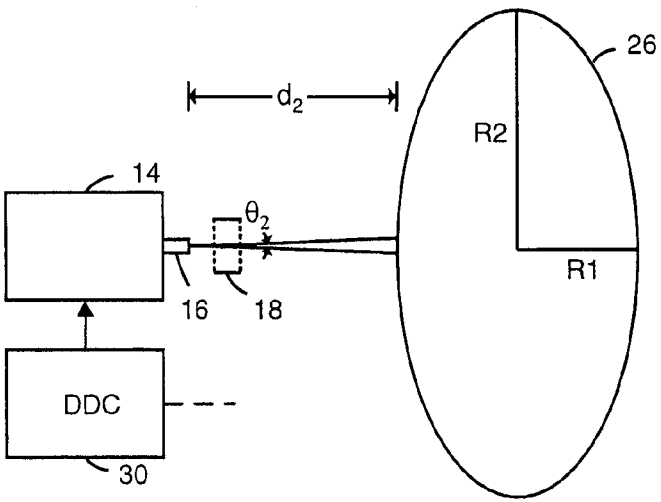

Referring to FIGS. 3A and 3B, a printing system 10 can be equipped with a second type of dynamic swath adjustment logic that can allow for printing on surfaces at variable distances from the nozzle 16. This type of implementation can include a modified drop deposition control module 30 that adjusts the extent of swathing in response to a target swath width information signal. This signal can take the form of a continuously updated target swath divergence angle value θ, or a continuously updated distance value d, which can be calculated or sensed. It can also take more indirect forms, such as a substrate advance timing signal and substrate shape information, such as can be obtained from a substrate profile.

In operation, the deposition control module 30 adjusts the swath width dynamically during printing. In the case of a rotating substrate with an uneven cross-section, for example, the deposition control module can dynamically scale a deflection voltage to achieve a uniform pixel spacing on all sides. This can be accomplished by adjusting the swath divergence angle θ as the substrate rotates to achieve a constant swath width at the substrate surface. When the distance $d_1$ between a bulge in the substrate 26 and the nozzle 16 is small, therefore, the swath divergence angle $\theta_1$ is made relatively large, and when the distance $d_2$ between a dip in the substrate and the nozzle is larger, the swath divergence angle $\theta_2$ is reduced. This technique is particularly well suited to depositing ink on rotating plastic bottles with oval cross-sections.

Figure 4A:
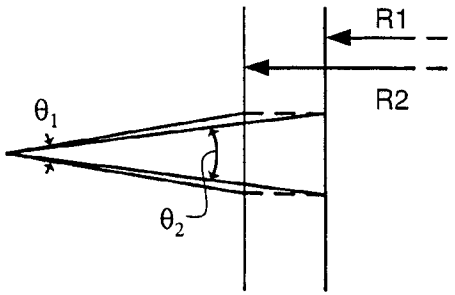
FIG. 4 is a diagram illustrating depth-dependent offset correction for the embodiment of FIG. 3.
Figure 4B:
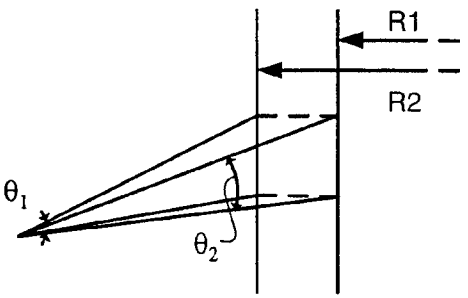

Referring to FIGS. 4A-4B, the deposition control module 30 may also need to correct for an offset. As shown in FIG. 4A, simply adjusting the width of a swath that is symmetrical about a normal to the axis of rotation of the substrate can be sufficient to cause printing to take place at the same position at all depths. But in other cases, as shown in FIG. 4B, a depth change can introduce a positional error. The deposition control module can add a depth-dependent offset value to the deflection voltage to correct for this type of error, in addition to the depth-dependent scaling. The two values can be calculated on the fly, stored in a table, or otherwise generated to allow for position-corrected deposition. The deposition control module can provide any combination of dynamic swath width adjustment, dynamic swath density adjustment, and collimated or otherwise redirected ink deposition.

Figure 5:
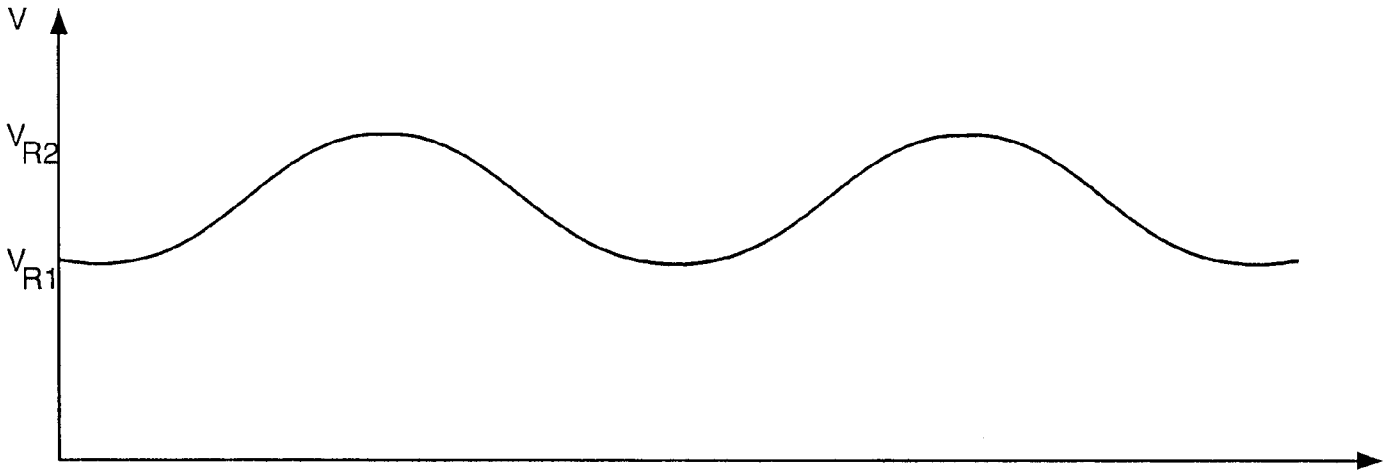
FIG. 5 is a diagrammatic plot of surface velocity at the jet against time for the embodiment of FIG. 3.

Referring to FIG. 5, it can also be important to adjust drop deposition timing to make up for variations in surface velocity. Rotation of an object having a non-cylindrical cross-section will exhibit variations in its surface velocity at the location or locations on its surface where drops are being deposited. In the case of an object with an elliptical cross section with minor axis R1 and major axis R2, for example, the surface velocity V will continuously vary between a minimum $V_{R1}$ corresponding to the minor axis and a maximum $V_{R2}$ corresponding to the major axis. The deposition control module can compensate for this variation by varying the timing of deposition of drops as the substrate rotates.

Figure 6:
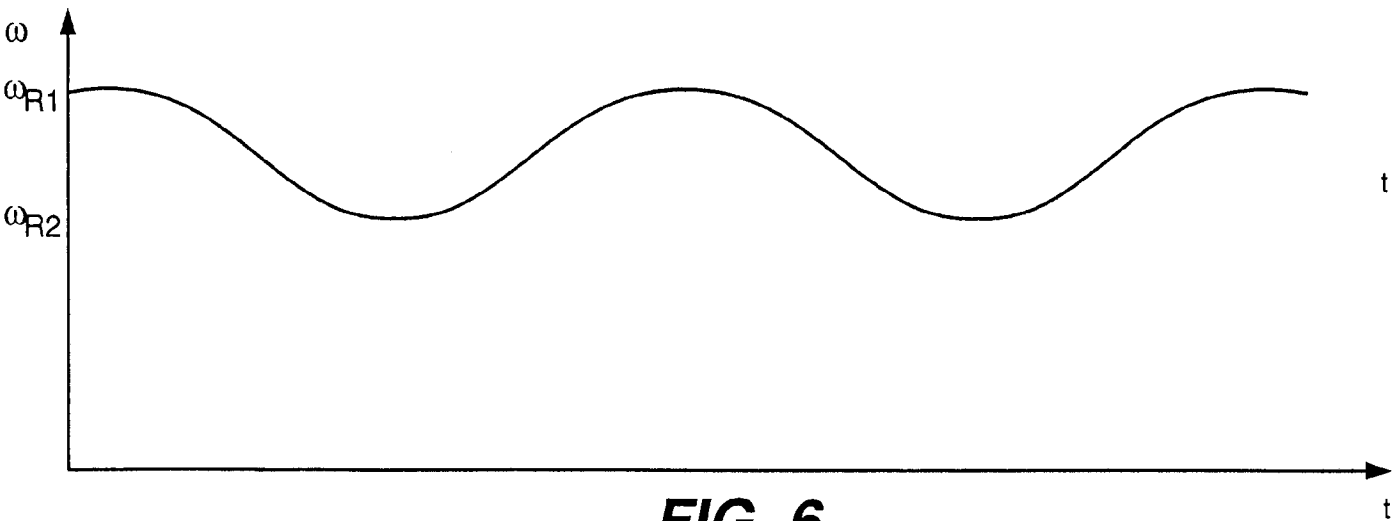
FIG. 6 is a diagrammatic plot of angular velocity at the jet against time for the embodiment of FIG. 3 equipped for variable-rotation of the substrate.

Referring to FIG. 6, the printing system 10 can also correct for variations in surface velocity by causing the substrate to rotate with a variable angular velocity ω. In the case of an object with an elliptical cross section with minor axis R1 and major axis R2, for example, the angular velocity will continuously vary between a minimum $\omega_{R1}$ corresponding to the major axis and a maximum $\omega_{R2}$ corresponding to the minor axis. The variable angular velocity is preferably achieved by adjusting motor speed, although a purely mechanical mechanism that alters angular velocity could also be provided. This mechanism could include a cam, linkage, non-circular gear, or another mechanical element that provides for variable angular velocity or varying the speed of rotation to obtain a constant surface velocity a the intersection of the drop stream and the media.

Figure 7:
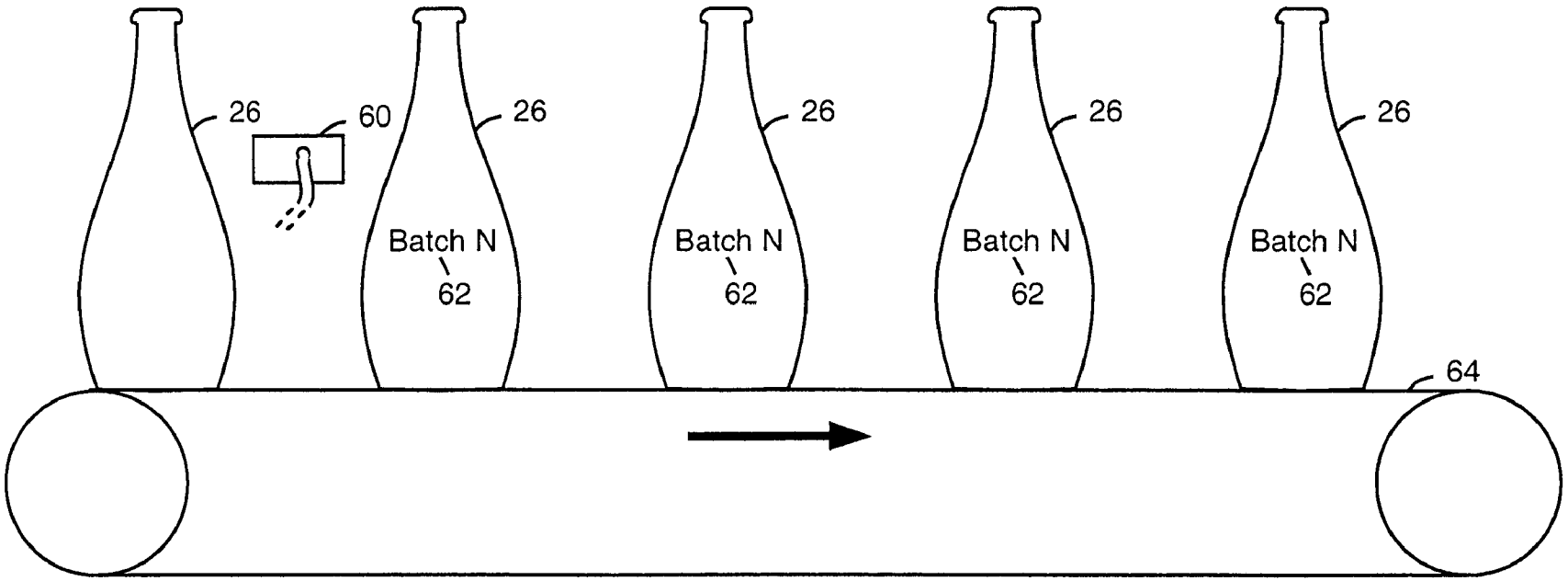
FIG. 7 is a diagram illustrating a large-scale batch-coding system according to the invention.

The invention can be applied to a variety of small-scale and large-scale labeling and decorating applications. For example, referring to FIG. 7, a printing head 60 employing features of the invention can deposit batch codes 62 onto three-dimensional substrates 26 as they are moved by a conveyor system 64. Other types of conveying mechanisms can of course be used to apply teachings of the invention to other types of labeling applications. This application of the invention permits improved text graphics and printing quality.

While the illustrative embodiment has focused on continuous ink-jet printing, features of the deflection systems according to the invention are also suitable for use in other types of printing systems. These can include other types of ink-based printing systems, such as drop-on-demand inkjet printers. They can also include other types of printing systems, such as direct-to-plate systems, which can dispense a plate-writing fluid. These fluids can include direct plate-writing fluids, which by themselves change properties of plates to allow them to be used in printing presses, and indirect plate-writing fluids, which require further process steps. The printing can be encoded to produce a half tone print, which the human eye tends to perceive as a continuous tone print.

It is also contemplated that features of the invention could be applied to print proofers, which simulate the output of other printers, as described in application Ser. No. 09/962,808, filed Sep. 24, 2001, entitled INKJET PROOFING WITH MATCHED COLOR AND SCREEN RESOLUTION, published as Application No. 20030058291, and herein incorporated by reference. The present invention may further benefit from combination with the teachings of application Ser. No. 10/842,196, entitled STITCHED PRINTING SYSTEM, filed on the same day as this application and herein incorporated by reference.

The present invention has now been described in connection with a number of specific embodiments thereof. However, numerous modifications which are contemplated as falling within the scope of the present invention should now be apparent to those skilled in the art. It is therefore intended that the scope of the present invention be limited only by the scope of the claims appended hereto. In addition, the order of presentation of the claims should not be construed to limit the scope of any particular term in the claims.

What is claimed is:

1. A jet printer, comprising:

a first jet printing nozzle;

at least one deflection element located proximate an output trajectory of the first jet printing nozzle and being positioned to deflect printing fluid drops exiting the first jet printing nozzle;

dynamic swath adjustment logic responsive to a dynamic swath adjustment signal and operative to dynamically adjust a signal provided to the deflection element during deposition of ink by the first ink jet printing nozzle; and wherein the dynamic swath adjustment signal is a target swath-width signal and wherein the dynamic swath adjustment logic is operative to scale the signal provided to the deflection element during deposition of ink by the first ink jet printing nozzle.

2. The jet printer of claim 1 wherein the dynamic swath-width adjustment logic further includes offset correction logic operative to introduce an offset in the signal provided to the deflection element during deposition of ink by the first ink jet printing nozzle.

3. The jet printer of claim 1 wherein the dynamic swath-width adjustment logic is responsive to a substrate advance signal and to substrate shape information.

4. The jet printer of claim 1 further including half-tone imaging logic operative to drive the printer to print half-tone images on the print substrate.

5. The jet printer of claim 1 wherein the print substrate is a printing plate.

6. The jet printer of claim 1 further including an actuating mechanism that includes an actuator for conveying a substrate that includes a three-dimensional printing surface.

7. The jet printer of claim 6 wherein the actuating mechanism is operative to hold a container.

8. The jet printer of claim 6 wherein the actuating mechanism is operative to hold a three-dimensional plastic object.

9. The jet printer of claim 8 wherein the actuating mechanism is operative to hold a plastic bottle.

10. The jet printer of claim 8 wherein the actuating mechanism is operative to hold at least a partially non-cylindrical plastic bottle.

11. The jet printer of claim 6 wherein the actuating mechanism is operative to hold a three-dimensional metal object.

12. The jet printer of claim 6 wherein the actuating mechanism is operative to hold a three-dimensional semi-rigid object.

* * * * *